US011715586B2

(12) United States Patent
Ohki et al.

(10) Patent No.: US 11,715,586 B2
(45) Date of Patent: Aug. 1, 2023

(54) SUPERCONDUCTING WIRE, SUPERCONDUCTING COIL, SUPERCONDUCTING MAGNET, AND SUPERCONDUCTING DEVICE

(71) Applicant: Sumitomo Electric Industries, Ltd., Osaka (JP)

(72) Inventors: Kotaro Ohki, Osaka (JP); Tatsuoki Nagaishi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 881 days.

(21) Appl. No.: 16/613,944

(22) PCT Filed: May 19, 2017

(86) PCT No.: PCT/JP2017/018879
§ 371 (c)(1),
(2) Date: Nov. 15, 2019

(87) PCT Pub. No.: WO2018/211700
PCT Pub. Date: Nov. 22, 2018

(65) Prior Publication Data

US 2021/0090769 A1 Mar. 25, 2021

(51) Int. Cl.

| | |
|---|---|
| ***H01F 6/06*** | (2006.01) |
| ***H01B 12/06*** | (2006.01) |
| ***H01F 6/04*** | (2006.01) |

(52) U.S. Cl.
CPC ..... *H01F 6/06* (2013.01); *H01B 12/06* (2013.01); *H01F 6/04* (2013.01)

(58) Field of Classification Search
CPC ..... H01F 6/06; H01F 6/04; H01B 12/06
See application file for complete search history.

(56) References Cited

U.S. PATENT DOCUMENTS

| | | | | |
|---|---|---|---|---|
| 4,894,906 | A * | 1/1990 | Huang | H01L 39/02 174/94 R |
| 2010/0245005 | A1* | 9/2010 | Takahashi | H01F 6/006 335/216 |
| 2012/0014030 | A1* | 1/2012 | Ichiki | H01F 6/02 335/216 |
| 2017/0011823 | A1* | 1/2017 | Jin | H01F 6/06 |
| 2017/0084371 | A1* | 3/2017 | Batz | H01F 41/12 |
| 2018/0025812 | A1 | 1/2018 | Ohki et al. | |

FOREIGN PATENT DOCUMENTS

| | | | | |
|---|---|---|---|---|
| WO | WO 2015/118732 | * | 8/2015 | H01B 12/02 |
| WO | WO-2016/129469 A1 | | 8/2016 | |

* cited by examiner

*Primary Examiner* — Paul A Wartalowicz
(74) *Attorney, Agent, or Firm* — Faegre Drinker Biddle & Reath LLP

(57) ABSTRACT

In a superconducting wire, a superconducting material joining layer joins a first end portion of a first superconducting material layer of a first wire and a second end portion of a second superconducting material layer of a second wire. The first wire and the second wire are disposed such that a first end face and a second end face are positioned to face in the same direction. The first wire further includes a first conductor layer disposed on the first main surface so as to be located adjacent to the first end portion. The second wire further includes a second conductor layer disposed on the second main surface so as to be located adjacent to the second end portion. The first conductor layer and the second conductor layer are connected to each other.

11 Claims, 10 Drawing Sheets

SUPERCONDUCTING WIRE, SUPERCONDUCTING COIL, SUPERCONDUCTING MAGNET, AND SUPERCONDUCTING DEVICE

TECHNICAL FIELD

The present invention relates to a superconducting wire, a superconducting coil, a superconducting magnet, and a superconducting device.

BACKGROUND ART

WO2016/129469 (PTL 1) discloses a superconducting wire including: a first wire including a first superconducting material layer; a second wire including a second superconducting material layer; and a superconducting material joining layer that joins the first superconducting material layer and the second superconducting material layer.

CITATION LIST

Patent Literature

PTL 1: WO2016/129469

SUMMARY OF INVENTION

A superconducting wire according to one embodiment of the present invention includes a first wire, a second wire, and a superconducting material joining layer. The first wire includes a first superconducting material layer having a first main surface. The second wire includes a second superconducting material layer having a second main surface. The superconducting material joining layer joins a first end portion of the first main surface and a second end portion of the second main surface. The first wire has a first end face located at one end of the first wire in a longitudinal direction of the first wire, the first end face being adjacent to the first end portion. The second wire has a second end face located at one end of the second wire in a longitudinal direction of the second wire, the second end face being adjacent to the second end portion. The first wire and the second wire are disposed such that the first end face and the second end face are positioned to face in the same direction. The first wire further includes a first conductor layer that is disposed on the first main surface so as to be located adjacent to the first end portion. The second wire further includes a second conductor layer that is disposed on the second main surface so as to be located adjacent to the second end portion. The first conductor layer and the second conductor layer are connected to each other.

DETAILED DESCRIPTION

Figure 1:
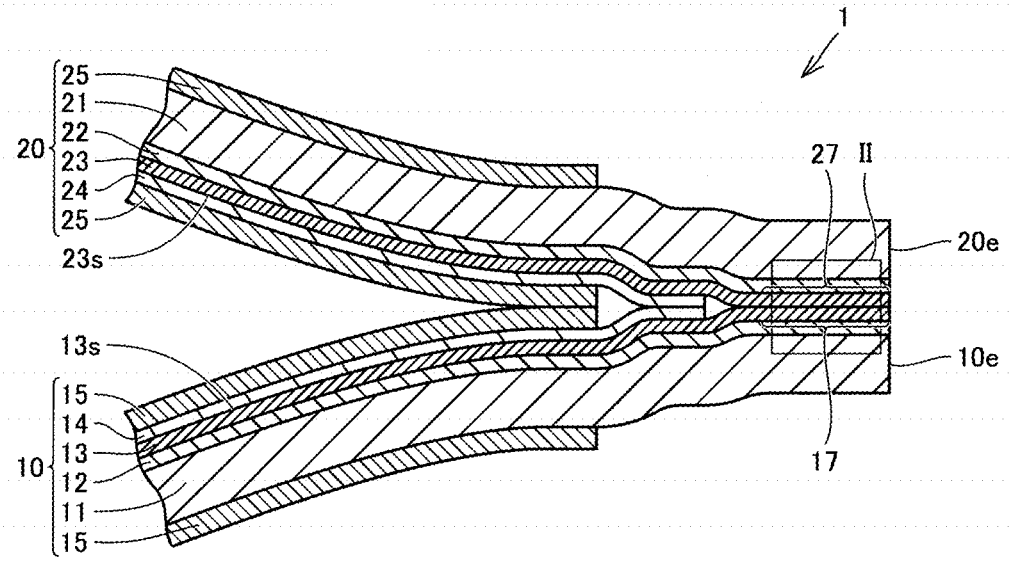
FIG. 1 is a schematic cross-sectional view of a superconducting wire according to the first embodiment.

Problem to be Solved by the Present Disclosure

The first object of the present disclosure is to provide a superconducting wire that can prevent burnout of a superconducting material joining layer by quenching. The second object of the present disclosure is to provide a superconducting coil including such a superconducting wire, a superconducting magnet, and a superconducting device.

Advantageous Effect of the Present Disclosure

The superconducting wire according to one embodiment of the present invention can prevent burnout of a superconducting material joining layer by quenching. The superconducting coil according to one embodiment of the present invention has high reliability. The superconducting magnet according to one embodiment of the present invention has high reliability. The superconducting device according to one embodiment of the present invention has high reliability.

DESCRIPTION OF EMBODIMENTS

The embodiments of the present invention will be first listed below for explanation.

(1) A superconducting wire 1 (see FIGS. 1 and 8) according to one embodiment of the present invention includes a first wire 10, a second wire 20, and a superconducting material joining layer 40. First wire 10 includes a first superconducting material layer 13 having a first main surface 13*s*. Second wire 20 includes a second superconducting material layer 23 having a second main surface 23*s*. Superconducting material joining layer 40 joins a first end portion 17 of first main surface 13*s* and a second end portion 27 of second main surface 23*s*. First wire 10 has a first end face 10*e* located at one end of first wire 10 in a longitudinal direction of first wire 10, first end face 10*e* being adjacent to first end portion 17. Second wire 20 has a second end face 20*e* located at one end of second wire 20 in a longitudinal direction of second wire 20, second end face 20*e* being adjacent to second end portion 27. First wire 10 and second wire 20 are disposed such that first end face 10*e* and second end face 20*e* are positioned to face in the same direction. First wire 10 further includes a first conductor layer (14) that is disposed on first main surface 13*s* so as to be located adjacent to first end portion 17. Second wire 20 further includes a second conductor layer (24) that is disposed on second main surface 23*s* so as to be located adjacent to second end portion 27. The first conductor layer and the second conductor layer are connected to each other.

In superconducting wire 1 according to the above (1), when quenching occurs in superconducting material joining layer 40, the current having flowed through first superconducting material layer 13, superconducting material joining layer 40 and second superconducting material layer 23 flows through first superconducting material layer 13, the first conductor layer, the second conductor layer, and second superconducting material layer 23. Thus, this current is prevented from flowing into superconducting material joining layer 40. In other words, the connecting portion between the first conductor layer and the second conductor layer may function as a bypass through which the flow of the current having flowed through superconducting material joining layer 40 is redistributed. This can prevent burnout of superconducting material joining layer 40 when quenching (the phenomenon in which the conducting state shifts from a superconducting state to a normal conducting state) occurs in superconducting material joining layer 40.

Furthermore, the connecting portion between the first conductor layer and the second conductor layer can increase the mechanical strength in the superconducting joining portion between first wire 10 and second wire 20.

(2) In superconducting wire 1 according to the above (1), a distance between first wire 10 and second wire 20 increases as first wire 10 and second wire 20 are away from superconducting material joining layer 40.

Superconducting wire 1 according to the above (2) may be applied to a superconducting coil that can be used in a permanent current mode. For example, superconducting wire 1 may be applied to a solenoid coil that is formed by winding a superconducting wire in a spiral shape. In this case, first end portion 17 of first wire 10 forming one drawn wire of a solenoid coil and second end portion 27 of second wire 20 forming the other drawn wire may be joined to each other with superconducting material joining layer 40 interposed therebetween.

Alternatively, superconducting wire 1 may be applied to a superconducting coil formed by stacking a plurality of double pancake coils on one another. In this case, first end portion 17 of first wire 10 forming one drawn wire of one double pancake coil and second end portion 27 of second wire 20 forming one drawn wire of another double pancake coil located adjacent to this one double pancake coil may be joined to each other with superconducting material joining layer 40 interposed therebetween.

In the embodiment of the present invention, first wire 10 and second wire 20 may be provided as one common wire, for example, which corresponds to the case where first end portion 17 of first wire 10 forms one end of one wire while second end portion 27 of second wire 20 forms the other end of this one wire. The present embodiment may be applied in the situation where this one wire is wound to form a superconducting coil.

(3) In superconducting wire 1 according to the above (1) or (2), the first conductor layer (14, 15) and the second conductor layer (24, 25) are connected to each other by diffusion joining. In superconducting wire 1 according to the above (3), the first conductor layer and the second conductor layer can be connected to each other in the heating and pressurizing step performed for superconducting-joining first end portion 17 of first superconducting material layer 13 and second end portion 27 of second superconducting material layer 23.

(4) In superconducting wire 1 according to the above (1) to (3), the first conductor layer (14, 15) includes a first protective layer 14 disposed on first main surface 13*s*. The second conductor layer (24, 25) includes a second protective layer 24 disposed on second main surface 23*s*. In superconducting wire 1 according to the above (4), the connecting portion between first protective layer 14 and second protective layer 24 may function as a bypass through which the flow of the current having flowed through superconducting material joining layer 40 is redistributed.

(5) In superconducting wire 1 according to the above (1) to (3), the first conductor layer (14, 15) includes: a first protective layer 14 disposed on first main surface 13*s*; and a first stabilization layer 15 disposed on first protective layer 14. The second conductor layer (24, 25) includes: a second protective layer 24 disposed on second main surface 23*s*; and a second stabilization layer 25 disposed on second protective layer 24.

In superconducting wire 1 according to the above (5), the connecting portion between first protective layer 14 and second protective layer 24, and the connecting portion between first stabilization layer 15 and second stabilization layer 25 each may function as a bypass through which the flow of the current having flowed through superconducting material joining layer 40 is redistributed.

(6) In superconducting wire 1 according to the above (1) to (5), first superconducting material layer 13 is formed of $RE1_1Ba_2Cu_3O_{y1}$ ($6.0 \leq y1 \leq 8.0$, RE1: a rare earth element). Second superconducting material layer 23 is formed of $RE2_1Ba_2Cu_3O_{y2}$ ($6.0 \leq y2 \leq 8.0$, RE2: a rare earth element). Superconducting material joining layer 40 is formed of $RE3_1Ba_2Cu_3O_{y3}$ ($6.0 \leq y3 \leq 8.0$, RE3: a rare earth element). Superconducting wire 1 according to the above (6) is applicable to superconducting joining between high-temperature superconducting wires.

(7) A superconducting coil 70 according to one embodiment of the present invention includes superconducting wire 1 according to any one of the above (1) to (6). Superconducting wire 1 is wound around a central axis of superconducting coil 70. Superconducting coil 70 according to the above (7) has high reliability.

(8) A superconducting magnet 100 according to one embodiment of the present invention includes: superconducting coil 70 according to the above (7); a cryostat 105 in which superconducting coil 70 is housed; and a refrigerator 102 configured to cool superconducting coil 70. Superconducting magnet 100 according to the above (8) has high reliability.

(9) A superconducting device 200 according to one embodiment of the present invention includes superconducting magnet 100 according to the above (8). Superconducting device 200 according to the above (9) has high reliability.

Details of the Embodiment of a Present Invention

In the following, superconducting wire 1 according to the embodiment of the present invention will be described. The same components will be designated by the same reference characters, and description thereof will not be repeated. At least some of the configurations in each embodiment described below may be arbitrarily combined.

First Embodiment

Figure 2:
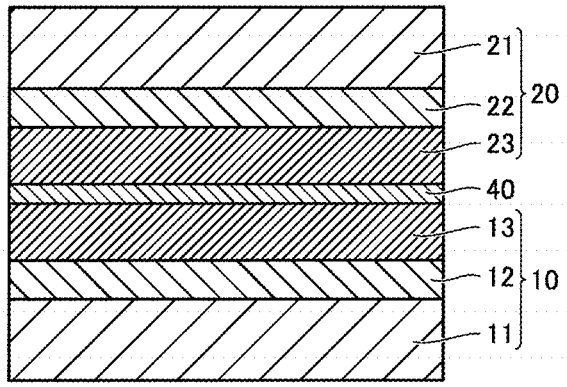
FIG. 2 is a partially enlarged schematic cross-sectional view of a region II shown in FIG. 1 of the superconducting wire according to the first embodiment.

Referring to FIGS. 1 and 2, a superconducting wire 1 according to the present embodiment mainly includes a first wire 10, a second wire 20, and a superconducting material joining layer 40. Superconducting wire 1 according to the present embodiment may further include a conductive member.

First wire 10 includes a first superconducting material layer 13 having a first main surface 13*s*. Specifically, first wire 10 may include: a first metal substrate 11; a first intermediate layer 12 disposed on first metal substrate 11; a first superconducting material layer 13 disposed on first intermediate layer 12; a first protective layer 14 disposed on first main surface 13*s* of first superconducting material layer 13; and a first stabilization layer 15 disposed on first protective layer 14. First wire 10 may further include first stabilization layer 15 disposed on first metal substrate 11 on the opposite side of first intermediate layer 12.

Second wire 20 includes a second superconducting material layer 23 having a second main surface 23*s*. Specifically, second wire 20 may include: a second metal substrate 21; a second intermediate layer 22 disposed on second metal substrate 21; a second superconducting material layer 23 disposed on second intermediate layer 22; a second protective layer 24 disposed on second main surface 23*s* of second superconducting material layer 23; and a second stabilization layer 25 disposed on second protective layer 24. Second wire 20 may further include second stabilization layer 25 disposed on second metal substrate 21 on the opposite side of second intermediate layer 22. Second wire 20 may be formed in the same manner as with first wire 10.

First metal substrate 11 and second metal substrate 21 each may be an oriented metal substrate. The oriented metal substrate means a metal substrate in which crystal orientations are aligned on the surface of the metal substrate. The oriented metal substrate may be, for example, a clad-type metal substrate in which a nickel layer, a copper layer and the like are disposed on a SUS or Hastelloy (registered trademark)-based metal substrate.

First intermediate layer 12 may be made of a material that has significantly low reactivity with first superconducting material layer 13 and that prevents reduction in superconducting characteristics of first superconducting material layer 13. Second intermediate layer 22 may be made of a material that has significantly low reactivity with second superconducting material layer 23 and that prevents reduction in superconducting characteristics of second superconducting material layer 23. First intermediate layer 12 and second intermediate layer 22 each may be formed of at least one of: YSZ (yttria-stabilized zirconia), $CeO_2$ (cerium oxide); MgO (magnesium oxide); $Y_2O_3$ (yttrium oxide); $Al_2O_3$ (aluminum oxide); $LaMnO_3$ (lanthanum manganese oxide); $Gd_2Zr_2O_7$ (gadolinium zirconate); and $SrTiO_3$ (strontium titanate), for example. First intermediate layer 12 and second intermediate layer 22 each may be formed of a plurality of layers.

When a SUS substrate or a Hastelloy substrate is used as first metal substrate 11 and second metal substrate 21, first intermediate layer 12 and second intermediate layer 22 each may be a crystal orientation layer formed, for example, by the IBAD (Ion Beam Assisted Deposition) method. When first metal substrate 11 has a surface with crystal orientation, first intermediate layer 12 may alleviate the crystal orientation difference between first metal substrate 11 and first superconducting material layer 13. When second metal substrate 21 has a surface with crystal orientation, second intermediate layer 22 may alleviate the crystal orientation difference between second metal substrate 21 and second superconducting material layer 23.

First superconducting material layer 13 corresponds to a portion in first wire 10, through which a superconducting current flows. Second superconducting material layer 23 corresponds to a portion in second wire 20, through which a superconducting current flows. First superconducting material layer 13 and second superconducting material layer 23 each may be made of an oxide superconducting material, though not particularly limited thereto. Specifically, first superconducting material layer 13 may be formed of $RE1_1Ba_2Cu_3O_{y1}$ ($6.0 \leq y1 \leq 8.0$; RE1 indicates a rare earth element). Second superconducting material layer 23 may be formed of $RE2_1Ba_2Cu_3O_{y2}$ ($6.0 \leq y2 \leq 8.0$; RE2 indicates a rare earth element). RE1 may be the same as RE2 or may be different from RE2. Further specifically, RE1 and RE2 each may be yttrium (Y), gadolinium (Gd), dysprosium (Dy), europium (Eu), lanthanum (La), neodymium (Nd), erbium (Er), thulium (Tm), ytterbium (Yb), lutetium (Lu), samarium (Sm), or holmium (Ho). Still further specifically, y1 and y2 each may be equal to or greater than 6.8 and equal to or less than 7.0.

First protective layer 14 is disposed on first main surface 13*s* of first superconducting material layer 13 so as to be adjacent to a first end portion 17 that is in contact with superconducting material joining layer 40. First protective layer 14 is not provided on first end portion 17 of first superconducting material layer 13. First end portion 17 of first superconducting material layer 13 is exposed from first protective layer 14. First protective layer 14 is formed of a conductive material such as silver (Ag) or a silver alloy. First protective layer 14 functions as a bypass through which the flow of the current having flowed through first superconducting material layer 13 is redistributed when first superconducting material layer 13 shifts from a superconducting state to a normal conducting state.

Second protective layer 24 is disposed on second superconducting material layer 23 so as to be adjacent to a second end portion 27 that is in contact with superconducting material joining layer 40. Second protective layer 24 is not provided on second end portion 27 of second superconducting material layer 23. Second end portion 27 of second superconducting material layer 23 is exposed from second protective layer 24. Second protective layer 24 is formed of a conductive material such as silver (Ag) or a silver alloy. Second protective layer 24 functions as a bypass through which the flow of the current having flowed through a second superconducting material layer 23 is redistributed when second superconducting material layer 23 shifts from a superconducting state to a normal conducting state.

First stabilization layer 15 is disposed on first protective layer 14. First stabilization layer 15 is not provided on first end portion 17 of first superconducting material layer 13 that is in contact with superconducting material joining layer 40. First end portion 17 of first superconducting material layer 13 is exposed from first stabilization layer 15. In a part of first wire 10 excluding first end portion 17 of first wire 10, first stabilization layer 15 surrounds first superconducting material layer 13. Specifically, in a part of first wire 10 excluding first end portion 17 of first wire 10, first stabilization layer 15 surrounds the first stacked body that is formed of first protective layer 14, first superconducting material layer 13, first intermediate layer 12, and first metal substrate 11.

Second stabilization layer 25 is in contact with second protective layer 24. Second stabilization layer 25 is not provided on second end portion 27 of second superconducting material layer 23 that is in contact with superconducting material joining layer 40. Second end portion 27 of second superconducting material layer 23 is exposed from second stabilization layer 25. In a part of second wire 20 excluding second end portion 27 of second wire 20, second stabilization layer 25 surrounds second superconducting material layer 23. Specifically, in a part of second wire 20 excluding second end portion 27 of second wire 20, second stabilization layer 25 surrounds the second stacked body that is formed of second protective layer 24, second superconducting material layer 23, second intermediate layer 22, and second metal substrate 21.

First stabilization layer 15 and second stabilization layer 25 each may be a metal layer having excellent electrical conductivity, such as copper (Cu) or a copper alloy, for example. Together with first protective layer 14, first stabilization layer 15 functions as a bypass through which the flow of the current having flowed through first superconducting material layer 13 is redistributed when first superconducting material layer 13 shifts from a superconducting state to a normal conducting state. Together with second protective layer 24, second stabilization layer 25 functions as a bypass through which the flow of the current having flowed through second superconducting material layer 23 is redistributed when second superconducting material layer 23 shifts from a superconducting state to a normal conducting state. First stabilization layer 15 and second stabilization layer 25 are thicker than first protective layer 14 and second protective layer 24, respectively.

Superconducting material joining layer 40 serves to join first end portion 17 of first main surface 13*s* of first superconducting material layer 13 and second end portion 27 of second main surface 23*s* of second superconducting material layer 23 to each other. Superconducting material joining layer 40 may be made of an oxide superconducting material, though not particularly limited thereto. Specifically, superconducting material joining layer 40 may be formed of $RE3_1Ba_2Cu_3O_{y3}$ ($6.0 \leq y3 \leq 8.0$; RE3 indicates a rare earth element). RE3 may be the same as RE1 or may be different from RE1. RE3 may be the same as RE2 or may be different from RE2. Further specifically, RE3 may be yttrium (Y), gadolinium (Gd), dysprosium (Dy), europium (Eu), lanthanum (La), neodymium (Nd), erbium (Er), thulium (Tm), ytterbium (Yb), lutetium (Lu), samarium (Sm), or holmium (Ho). Still further specifically, y3 may be equal to or greater than 6.8 and equal to or less than 7.0.

First wire 10 has a first end face 10*e* located at one end of first wire 10 in its longitudinal direction. First end face 10*e* is adjacent to first end portion 17. Second wire 20 has a second end face 20*e* located at one end of second wire 20 in its longitudinal direction. Second end face 20*e* is adjacent to second end portion 27.

First wire 10 and second wire 20 are disposed such that first end face 10*e* and second end face 20*e* are positioned to face in the same direction. In other words, first wire 10 and second wire 20 have a shape folded in superconducting material joining layer 40. The distance between first wire 10 and second wire 20 increases as first wire 10 and second wire 20 are away from superconducting material joining layer 40.

First protective layer 14 and second protective layer 24 are connected to each other in a portion where first protective layer 14 and second protective layer 24 are adjacent to superconducting material joining layer 40. This connecting portion between first protective layer 14 and second protective layer 24 may serves as a bypass for the current having flowed through first superconducting material layer 13, superconducting material joining layer 40 and second superconducting material layer 23 when quenching occurs in superconducting material joining layer 40.

Superconducting wire 1 according to the present embodiment may be applied to a superconducting coil that can be used in a permanent current mode. Specifically, first wire 10 and second wire 20 may be connected to a superconducting coil (not shown) to form a superconducting closed loop circuit.

Furthermore, first wire 10 and second wire 20 may be provided as one common wire, for example, which corresponds to the case where first end portion 17 is formed at one end of one wire and second end portion 27 is formed at the other end of this one wire. In this case, this one wire is wound to form a superconducting coil, and both ends of this one wire are superconducting-joined to each other, thereby forming a superconducting closed loop circuit.

Figure 3:
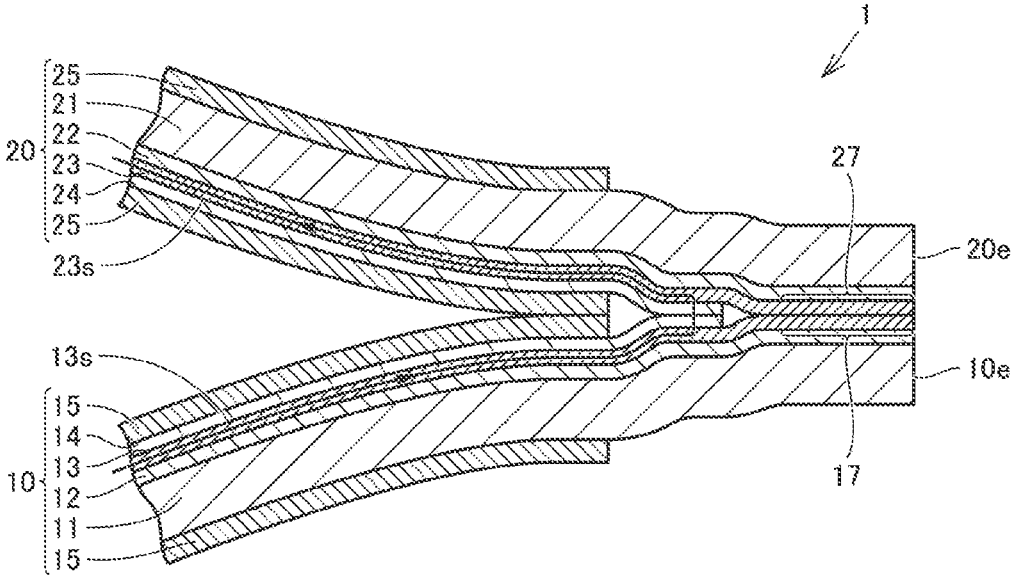
FIG. 3 is a schematic cross-sectional view for illustrating a current flowing through the superconducting wire according to the first embodiment.

FIG. 3 schematically shows a path of the current that flows through superconducting wire 1 when quenching occurs in superconducting material joining layer 40. In FIG. 3, arrows show a current path in the case where a current flows from first wire 10 into second wire 20. As shown in FIG. 3, the current flows from first superconducting material layer 13 into second superconducting material layer 23 through the connecting portion between first protective layer 14 and second protective layer 24.

When superconducting material joining layer 40 undergoes deterioration such as exfoliation in the superconducting joining portion between first wire 10 and second wire 20, quenching may occur in superconducting material joining layer 40. Since occurrence of quenching generates Joule heat, the temperature of superconducting material joining layer 40 suddenly rises, which may lead to burnout of superconducting material joining layer 40.

In superconducting wire 1 according to the present embodiment, when quenching occurs in superconducting material joining layer 40, the current having flowed through first superconducting material layer 13, superconducting material joining layer 40 and second superconducting material layer 23 is to flow through first superconducting material layer 13, first protective layer 14, second protective layer 24, and second superconducting material layer 23. Thus, this current is prevented from flowing into superconducting material joining layer 40. Accordingly, even though quenching occurs in superconducting material joining layer 40, burnout of superconducting material joining layer 40 can be prevented.

As shown in FIG. 3, first stabilization layer 15 and second stabilization layer 25 may be connected to each other at the end of superconducting material joining layer 40. This connecting portion between first stabilization layer 15 and second stabilization layer 25 may serve as a bypass for the current having flowed through first superconducting material layer 13, superconducting material joining layer 40 and second superconducting material layer 23 when quenching occurs in superconducting material joining layer 40, in the same manner as with the connecting portion between first protective layer 14 and second protective layer 24.

In other words, in superconducting wire 1 according to the present embodiment, first protective layer 14 and first stabilization layer 15 form the "first conductor layer" in the present disclosure while second protective layer 24 and second stabilization layer 25 form the "second conductor layer" in the present disclosure. As the first conductor layer and the second conductor layer are connected to each other, the current having flowed through superconducting material joining layer 40 can be caused to bypass superconducting material joining layer 40 when quenching occurs in superconducting material joining layer 40. Also, the mechanical strength in the superconducting joining portion between first wire 10 and second wire 20 can be increased.

Then, referring to FIGS. 4 to 7, a method of manufacturing superconducting wire 1 according to the present embodiment will be described.

Figure 4:
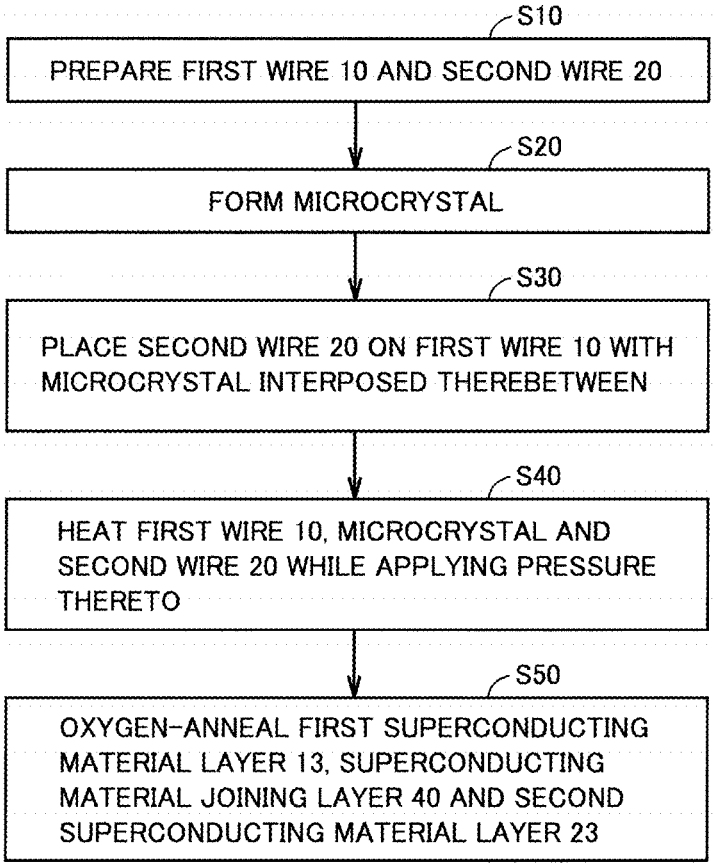
FIG. 4 shows a flowchart of a method of manufacturing the superconducting wire according to the first embodiment.

As shown in FIG. 4, the method of manufacturing superconducting wire 1 according to the present embodiment includes the step (S10) of preparing: first wire 10 including first superconducting material layer 13 having first main surface 13*s*; and second wire 20 including second superconducting material layer 23 having second main surface 23*s*.

The method of manufacturing superconducting wire 1 according to the present embodiment further includes the step (S20) of forming a microcrystal of an oxide superconducting material that forms superconducting material joining layer 40 on at least one of first end portion 17 of first main surface 13*s* and second end portion 27 of second main surface 23*s*. The following is an explanation with reference to FIG. 5 about the step of forming the first microcrystal in the method of manufacturing superconducting wire 1 according to the present embodiment.

The step (S20) of forming a microcrystal includes the step (S21) of forming a film, which contains an organic compound of an element forming superconducting material joining layer 40, on at least one of first end portion 17 of first superconducting material layer 13 and second end portion 27 of second superconducting material layer 23. In one example, the solution containing the organic compound of the element forming superconducting material joining layer 40 is applied onto at least one of first end portion 17 of first superconducting material layer 13 and second end portion 27 of second superconducting material layer 23. An example of this solution used in this case may specifically be a source material solution in the MOD method, that is, a solution made of an organic solvent containing a dissolved organic compound (for example, an organic metal compound or an organic metal complex) of the element constituting $RE3_1Ba_2Cu_3O_{y3}$ as a material of superconducting material joining layer 40. The organic compound may be an organic compound not containing fluorine.

The step (S20) of forming a microcrystal further includes the step (S22) of calcining the film containing the organic compound of the element that forms superconducting material joining layer 40. Specifically, this film is calcined at the first temperature. The first temperature is equal to or higher than the decomposition temperature of the above-mentioned organic compound, and is lower than the temperature at which the oxide superconducting material that forms superconducting material joining layer 40 is produced. Thereby, the organic compound contained in this film is thermally decomposed and formed as a precursor of the oxide superconducting material (the film containing this precursor will be hereinafter referred to as a calcined film). The precursor of the oxide superconducting material contains $BaCO_3$ that is a carbon compound of Ba, an oxide of a rare earth element (RE3) and CuO, for example. The calcining step (S22) may be performed at the first temperature such as approximately 500° C. and in the atmosphere at an oxygen concentration equal to or greater than 20%, for example.

The step (S20) of forming a microcrystal further includes the step (S23) of heating the calcined film at the second temperature higher than the first temperature to thermally decompose the carbon compound contained in the calcined film. The second temperature may be equal to or higher than 650° C. and equal to or lower than 800° C., for example. The carbon compound contained in the calcined film is thermally decomposed to obtain an oxide superconducting material that forms superconducting material joining layer 40. The step (S23) of thermally decomposing the carbon compound contained in the calcined film is performed in the atmosphere at the first oxygen concentration. The first oxygen concentration is equal to or greater than 1% and equal to or less than 100% (oxygen partial pressure of 1 atm). This suppresses the average grain size of each microcrystal exceeding 300 nm as a result of growth of each microcrystal. In this way, a microcrystal of the oxide superconducting material forming superconducting material joining layer 40 is formed on at least one of first end portion 17 of first superconducting material layer 13 and second end portion 27 of second superconducting material layer 23.

Figure 5:
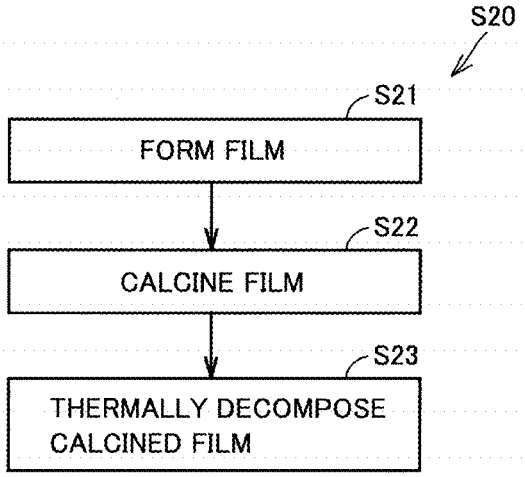
FIG. 5 shows a flowchart of the steps of forming a microcrystal in the method of manufacturing the superconducting wire according to the first embodiment.

As apparent from the two-dimensional X-ray diffraction image of superconducting material joining layer 40 (RE3=Gd) obtained after the microcrystal forming step (S20) shown in FIG. 5, that is, after the step (S23) of thermally decomposing the carbon compound contained in the calcined film, $RE3_1Ba_2Cu_3O_{y3}$ (RE3=Gd) is produced as a result of thermal decomposition of the carbon compound such as $BaCO_3$ contained in the calcined film after the step (S23) of thermally decomposing the carbon compound contained in the calcined film. Also, a ring-shaped diffraction pattern of $RE3_1Ba_2Cu_3O_{y3}$ (103) showing a randomly-oriented microcrystal is observed.

As shown in FIG. 4, the method of manufacturing superconducting wire 1 according to the present embodiment further includes the step (S30) of placing second wire 20 on first wire 10 with a microcrystal interposed therebetween. The step of placing second wire 20 on first wire 10 with a microcrystal interposed therebetween includes stacking first end portion 17 of first wire 10 and second end portion 27 of second wire 20 with a microcrystal interposed therebetween, as shown in FIG. 6.

Figure 6:
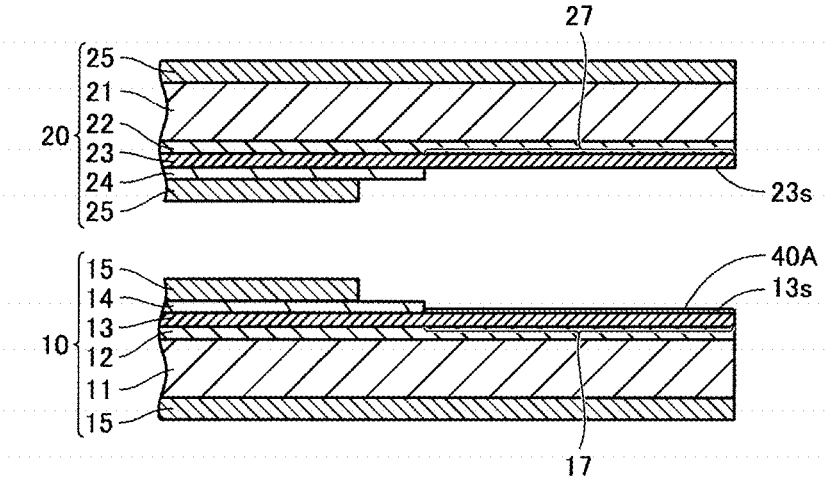
FIG. 6 is a diagram for illustrating the placing step in the method of manufacturing the superconducting wire according to the first embodiment.

In the example in FIG. 6, a microcrystal 40A is formed on first end portion 17 of first superconducting material layer 13. Microcrystal 40A may be formed on second end portion 27 of second superconducting material layer 23.

Figure 7:
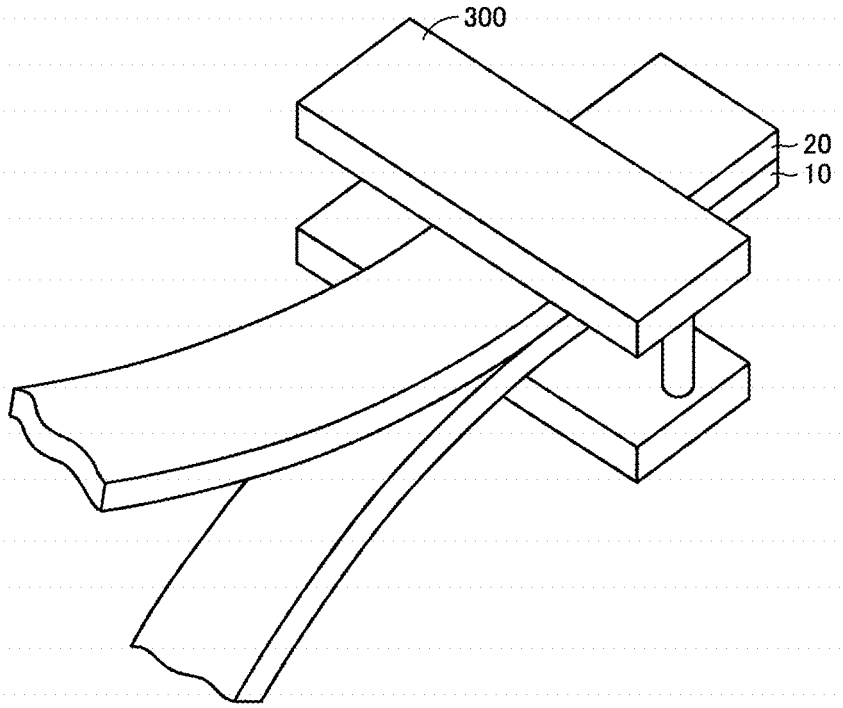
FIG. 7 is a diagram for illustrating the heating and pressurizing step in the method of manufacturing the superconducting wire according to the first embodiment.

The method of manufacturing superconducting wire 1 according to the present embodiment further includes the step (S40) of heating first wire 10, the microcrystal and second wire 20 while applying pressure thereto, to thereby produce superconducting material joining layer 40 from microcrystal 40A. Specifically, as shown in FIG. 7, a pressing jig 300 is used to press first wire 10 and second wire 20 against each other, to thereby apply pressure equal to or greater than 1 MPa to first wire 10, microcrystal 40A and second wire 20. In addition, first wire 10 and second wire 20 are arranged such that the distance between first wire 10 and second wire 20 increases as first wire 10 and second wire 20 are away from pressing jig 300.

While pressure is applied to first wire 10, microcrystal 40A and second wire 20, first wire 10, the microcrystal and second wire 20 are heated at the third temperature in the atmosphere at the second oxygen concentration. The third temperature is equal to or higher than the second temperature and is equal to or higher than the temperature at which an oxide superconducting material that forms superconducting material joining layer 40 is produced. The second oxygen concentration is lower than the first oxygen concentration. The second oxygen concentration may be 100 ppm, for example.

In this heating and pressurizing step (S40), microcrystal 40A produced in the step (S23) of thermally decomposing a calcined film is grown to produce superconducting material joining layer 40 formed of a crystal having a relatively large grain size. The microcrystal is grown along the crystal orientation of at least one of first superconducting material layer 13 and second superconducting material layer 23 each having a film formed thereon in the film formation step (S21). Thereby, superconducting material joining layer 40 is produced. In this way, first superconducting material layer 13 of first wire 10 and second superconducting material layer 23 of second wire 20 are joined to each other with superconducting material joining layer 40 interposed therebetween.

In the heating and pressurizing step (S40), first protective layer 14 and second protective layer 24 are connected to each other by diffusion joining. Diffusion joining is a jointing method of implementing solid phase-diffusion of silver or a silver alloy by performing heat treatment while applying pressure to the joining surface between first protective layer 14 and second protective layer 24. Furthermore, first stabilization layer 15 and second stabilization layer 25 may be connected to each other by diffusion joining. In this way, the first conductor layer of first wire 10 and the second conductor layer of second wire 20 are connected to each other at the end of superconducting material joining layer 40.

The method of manufacturing superconducting wire 1 according to the present embodiment further includes the step (S50) of oxygen-annealing first superconducting material layer 13, superconducting material joining layer 40 and second superconducting material layer 23. The oxygen annealing step (S50) is performed at the fourth temperature in the atmosphere at the third oxygen concentration. The fourth temperature is equal to or lower than the third temperature. The fourth temperature may be equal to or higher than 200° C. and equal to or lower than 500° C. The third oxygen concentration is higher than the second oxygen concentration. The third oxygen concentration may be 100% (oxygen partial pressure of 1 atm), for example. In the oxygen annealing step (S50), oxygen may be sufficiently supplied in a short period of time to first superconducting material layer 13, superconducting material joining layer 40 and second superconducting material layer 23. Through the above-described steps, superconducting wire 1 according to the present embodiment can be manufactured.

The effect of superconducting wire 1 according to the present embodiment will be hereinafter described.

In superconducting wire 1 according to the present embodiment, when quenching occurs in superconducting material joining layer 40, the current having flowed through first superconducting material layer 13, superconducting material joining layer 40 and second superconducting material layer 23 flows through first superconducting material layer 13, the first conductor layer (first protective layer 14 and first stabilization layer 15), the second conductor layer (second protective layer 24 and second stabilization layer 25), and second superconducting material layer 23. Accordingly, this current is prevented from flowing into superconducting material joining layer 40. In other words, the connecting portion between the first conductor layer and the second conductor layer may function as a bypass through which the flow of the current having flowed through superconducting material joining layer 40 is redistributed. Thereby, burnout of superconducting material joining layer 40 can be prevented when quenching occurs in superconducting material joining layer 40.

Modification of First Embodiment

The above first embodiment has been explained with regard to the configuration in which first protective layer 14 disposed on first main surface 13*s* of first superconducting material layer 13 and second protective layer 24 disposed on second main surface 23*s* of second superconducting material layer 23 are connected to each other while first stabilization layer 15 disposed on first protective layer 14 and second stabilization layer 25 disposed on second protective layer 24 are connected to each other. However, even by the configuration in which only first protective layer 14 and second protective layer 24 are connected to each other as shown in FIG. 8, the same effect as that achieved in the first embodiment can also be achieved.

Figure 8:
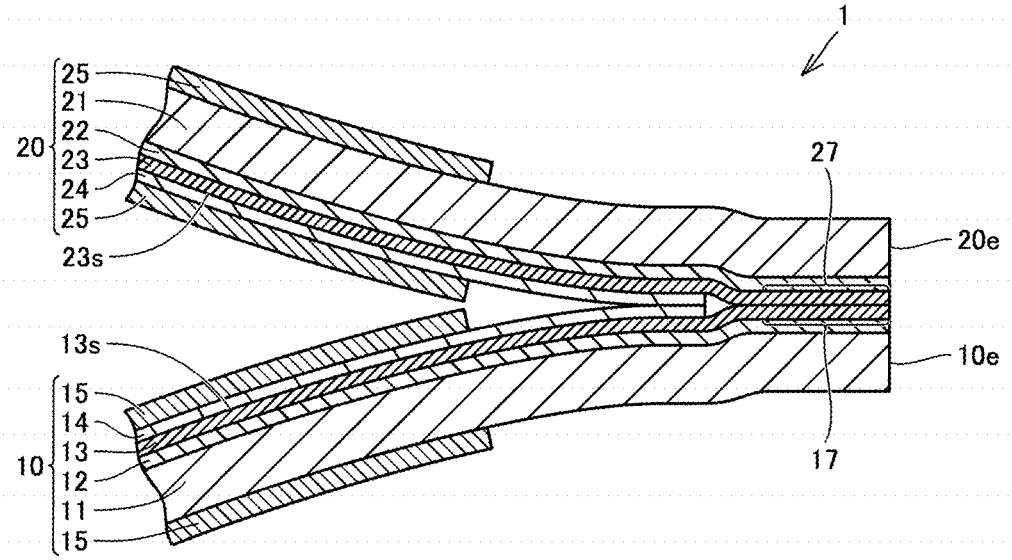
FIG. 8 is a schematic cross-sectional view of a superconducting wire according to a modification of the first embodiment.

Specifically, in superconducting wire 1 shown in FIG. 8, first stabilization layer 15 and second stabilization layer 25 are not connected to each other. Thus, only the connecting portion between first protective layer 14 and second protective layer 24 functions as a bypass through which the flow of the current having flowed through superconducting material joining layer 40 is redistributed. In other words, in the present modification, first protective layer 14 forms the "first conductor layer" in the present disclosure, and second protective layer 24 forms the "second conductor layer" in the present disclosure.

Second Embodiment

Figure 9:
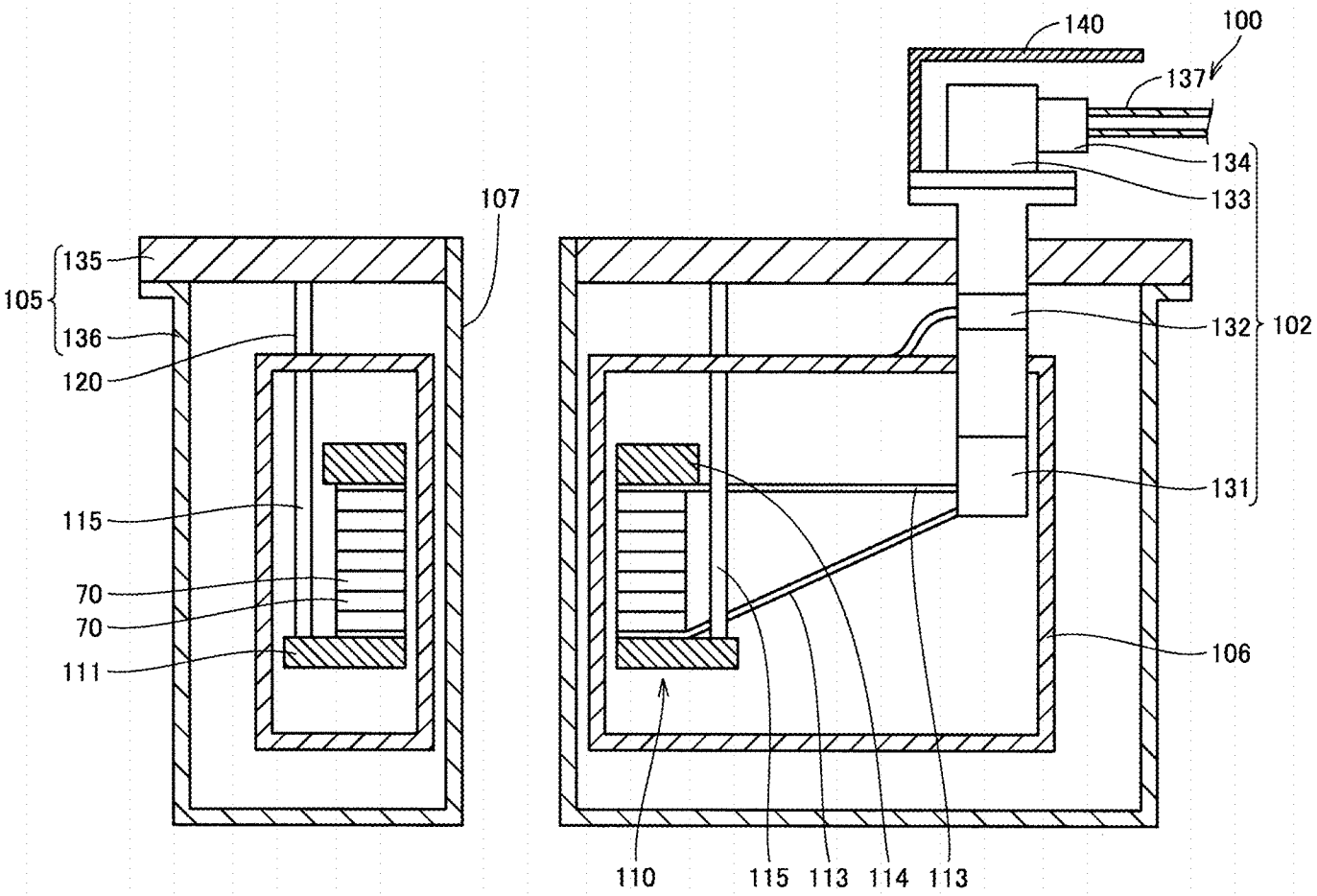
FIG. 9 is a schematic cross-sectional view of a superconducting magnet according to the second embodiment.

Referring to FIG. 9, a superconducting magnet 100 according to the second embodiment will be hereinafter described.

Superconducting magnet 100 according to the present embodiment mainly includes a superconducting coil 70 including superconducting wire 1 in the first embodiment, a cryostat 105 in which superconducting coil 70 is housed, and a refrigerator 102 for cooling superconducting coil 70. Specifically, superconducting magnet 100 may further include a heat shield 106 held inside cryostat 105, and a magnetic body shield 140.

In superconducting coil 70, superconducting wire 1 is wound around the central axis of superconducting coil 70. Although not shown, first wire 10 and second wire 20 are connected to superconducting coil 70, thereby forming a superconducting closed loop circuit.

Superconducting coil body 110 including superconducting coil 70 is housed in cryostat 105. Superconducting coil body 110 is held inside heat shield 106. Superconducting coil body 110 includes a plurality of superconducting coils 70, an upper support portion 114, and a lower support portion 111. The plurality of superconducting coils 70 are stacked on one another. Upper support portion 114 and lower support portion 111 are disposed such that the upper end face and the lower end face of the stacked superconducting coils 70 are sandwiched therebetween.

A cooling plate 113 is disposed on each of the upper end face and the lower end face of the stacked superconducting coils 70. A cooling plate (not shown) is disposed also between superconducting coils 70 that are adjacent to each other. Cooling plate 113 has one end connected to a second cooling head 131 of refrigerator 102. The cooling plate (not shown) disposed between superconducting coils 70 that are adjacent to each other has one end that is also connected to second cooling head 131. A first cooling head 132 of refrigerator 102 may be connected to the wall portion of heat shield 106. Thus, the wall portion of heat shield 106 may also be cooled by refrigerator 102.

Lower support portion 111 of superconducting coil body 110 is larger in size than the plane shape of superconducting coil 70. Lower support portion 111 is fixed to heat shield 106 by a plurality of support members 115. The plurality of support members 115 each are formed as a rod-shaped member and serve to connect the upper wall of heat shield 106 to the outer circumferential portion of lower support portion 111. The plurality of support members 115 are disposed on the outer circumferential portion of superconducting coil body 110. Support members 115 are disposed at regular intervals so as to surround superconducting coil 70.

Heat shield 106 holding superconducting coil body 110 is connected to cryostat 105 by connecting portions 120. Connecting portions 120 are disposed at regular intervals along the outer circumferential portion of superconducting coil body 110 so as to surround the central axis of superconducting coil body 110. Connecting portions 120 each connect a cover body 135 of cryostat 105 to the upper wall of heat shield 106.

Refrigerator 102 is disposed so as to extend from the upper portion of cover body 135 of cryostat 105 to the inside of heat shield 106. Refrigerator 102 serves to cool superconducting coil body 110. Specifically, a body portion 133 and a motor 134 of refrigerator 102 are disposed on the upper surface of cover body 135. Refrigerator 102 is disposed so as to extend from body portion 133 to the inside of heat shield 106.

Refrigerator 102 may be a Gifford-McMahon type refrigerator, for example. Refrigerator 102 is connected through a pipe line 137 to a compressor (not shown) that compresses refrigerant. The refrigerant (for example, helium gas) compressed by the compressor into high pressure is supplied to refrigerator 102. This refrigerant is expanded by a displacer driven by motor 134, so that a cold storage medium placed inside refrigerator 102 is cooled. The refrigerant expanded and thereby converted into low pressure is returned to the compressor and then again compressed to high pressure.

First cooling head 132 of refrigerator 102 cools heat shield 106 to thereby prevent external heat from coming into heat shield 106. Second cooling head 131 of refrigerator 102 cools superconducting coil 70 through cooling plate 113. In this way, superconducting coil 70 is brought into a superconducting state.

Cryostat 105 includes a cryostat body portion 136 and a cover body 135. Body portion 133 and motor 134 are surrounded by magnetic body shield 140. Magnetic body shield 140 may prevent a part of the magnetic field produced from superconducting coil body 110 from coming into motor 134.

Superconducting magnet 100 is provided with an opened hollow space 107 passing through cryostat 105 and heat shield 106 and extending from cover body 135 of cryostat 105 to the bottom wall of cryostat body portion 136. Opened hollow space 107 is disposed so as to pass through the center portion of superconducting coil 70 of superconducting coil body 110. In the state where an object to be detected 210 (see FIG. 10) is disposed inside opened hollow space 107, the magnetic field produced from superconducting coil body 110 is applied to object to be detected 210.

The effect of superconducting coil 70 according to the present embodiment will be hereinafter described. Superconducting coil 70 according to the present embodiment includes superconducting coil 70 including superconducting wire 1. Superconducting wire 1 is wound around the central axis of the superconducting coil. Accordingly, superconducting coil 70 according to the present embodiment has high reliability.

The effect of superconducting magnet 100 according to the present embodiment will be hereinafter described. Superconducting magnet 100 according to the present embodiment includes: superconducting coil 70 including superconducting wire 1; cryostat 105 in which superconducting coil 70 is housed; and refrigerator 102 configured to cool superconducting coil 70. Thus, superconducting magnet 100 according to the present embodiment has high reliability.

Third Embodiment

Figure 10:
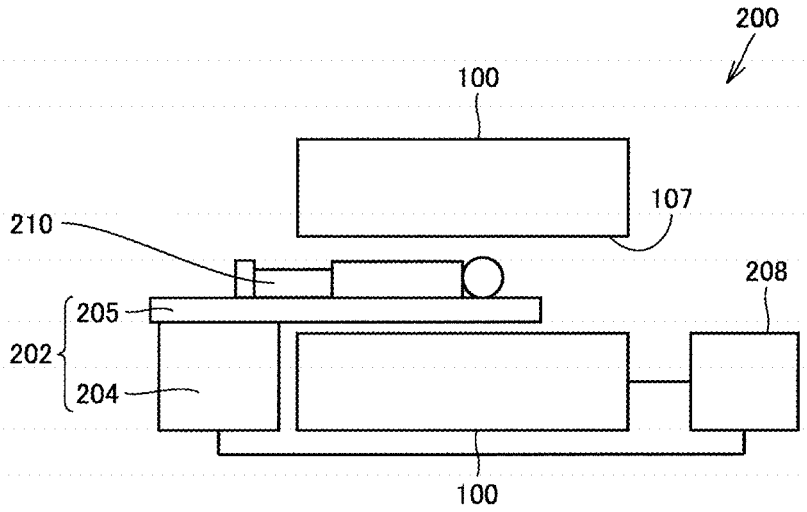
FIG. 10 is a schematic side view of a superconducting device according to the third embodiment.

Referring to FIG. 10, a superconducting device 200 according to the third embodiment will be hereinafter described. Superconducting device 200 according to the present embodiment may be a magnetic resonance imaging (MRI) apparatus, for example.

Superconducting device 200 according to the present embodiment mainly includes superconducting magnet 100 according to the second embodiment. Superconducting device 200 according to the present embodiment may further include a movable base 202 and a controller 208. Movable base 202 includes: a top plate 205 on which object to be detected 210 is placed; and a drive unit 204 for moving top plate 205. Controller 208 is connected to superconducting magnet 100 and drive unit 204.

Controller 208 drives superconducting magnet 100 to produce a uniform magnetic field inside opened hollow space 107 of superconducting magnet 100. Controller 208 moves movable base 202 such that object to be detected 210 placed on movable base 202 is introduced into opened hollow space 107 of superconducting magnet 100. When image pick-up of object to be detected 210 is completed, controller 208 moves movable base 202 such that object to be detected 210 placed on movable base 202 is moved out of opened hollow space 107 of superconducting magnet 100.

The effect of superconducting device 200 according to the present embodiment will be hereinafter described. Superconducting device 200 according to the present embodiment includes superconducting magnet 100. Thus, superconducting device 200 according to the present embodiment has high reliability.

It should be understood that the first to third embodiments disclosed herein are illustrative and non-restrictive in every respect. The scope of the present invention is defined by the terms of the claims, rather than the description of the first to third embodiments provided above, and is intended to include any modifications within the meaning and scope equivalent to the terms of the claims.

REFERENCE SIGNS LIST

1 superconducting wire, 10 first wire, 11 first metal substrate, 12 first intermediate layer, 13 first superconducting material layer, 13*s* first main surface, 14 first protective layer, 15 first stabilization layer, 17 first end portion, 20 second wire, 21 second metal substrate, 22 second intermediate layer, 23 second superconducting material layer, 23*s* second main surface, 24 second protective layer, 25 second stabilization layer, 27 second end portion, 40 superconducting material joining layer, 40A microcrystal, 70 superconducting coil, 100 superconducting magnet, 102 refrigerator, 105 cryostat, 106 heat shield, 107 opened hollow space, 110 superconducting coil body, 111 lower support portion, 113 cooling plate, 114 upper support portion, 115 support member, 120 connecting portion, 131 second cooling head, 132 first cooling head, 133 body portion, 134 motor, 135 cover body, 136 cryostat body portion, 137 pipe line, 140 magnetic body shield, 200 superconducting device, 202 movable base, 204 drive unit, 205 top plate, 208 controller, 210 object to be detected, 300 pressing jig.

The invention claimed is:

1. A superconducting wire comprising:

a first wire including a first superconducting material layer having a first main surface;

a second wire including a second superconducting material layer having a second main surface; and a superconducting material joining layer that joins a first end portion of the first main surface and a second end portion of the second main surface, wherein at the first end portion, the first main surface joins a first surface of the superconducting material joining layer, at the second end portion, the second main surface joins a second surface of the superconducting material joining layer, the second surface of the superconducting material joining layer is opposite the first surface of the superconducting material joining layer, the first wire has a first end face located at one end of the first wire in a longitudinal direction of the first wire, the first end face being adjacent to the first end portion, the second wire has a second end face located at one end of the second wire in a longitudinal direction of the second wire, the second end face being adjacent to the second end portion, the first wire and the second wire are disposed such that the first end face and the second end face are positioned to face in the same direction, the first wire further includes a first conductor layer that is disposed on the first main surface so as to be located adjacent to the first end portion, the second wire further includes a second conductor layer that is disposed on the second main surface so as to be located adjacent to the second end portion, and the first conductor layer and the second conductor layer are connected to each other.

2. The superconducting wire according to claim 1, wherein a distance between the first wire and the second wire increases as the first wire and the second wire are away from the superconducting material joining layer.

3. The superconducting wire according to claim 1, wherein the first conductor layer and the second conductor layer are connected to each other by diffusion joining.

4. The superconducting wire according to claim 1, wherein the first conductor layer includes a first protective layer disposed on the first main surface, and the second conductor layer includes a second protective layer disposed on the second main surface.

5. The superconducting wire according to claim 1, wherein the first conductor layer includes a first protective layer disposed on the first main surface, and a first stabilization layer disposed on the first protective layer, and the second conductor layer includes a second protective layer disposed on the second main surface, and a second stabilization layer disposed on the second protective layer.

6. The superconducting wire according to claim 1, wherein the first superconducting material layer is formed of $RE1_1Ba_2Cu_3O_{y1}$ ($6.0 \leq y1 \leq 8.0$, RE1: a rare earth element), the second superconducting material layer is formed of $RE2_1Ba_2Cu_3O_{y2}$ ($6.0 \leq y2 \leq 8.0$, RE2: a rare earth element), and the superconducting material joining layer is formed of $RE3_1Ba_2Cu_3O_{y3}$ ($6.0 \leq y3 \leq 8.0$, RE3: a rare earth element).

7. The superconducting wire according to claim 1, wherein a current having first flowed through the first superconducting material layer, the superconducting material joining layer, and the second superconducting material layer then flows through the first superconducting material layer, the first conductor layer, the second conductor layer, and the second superconducting material layer, and the current is prevented from flowing back into superconducting material joining layer.

8. The superconducting wire according to claim 1, further comprising:

a connecting portion between the first conductive layer and the second conductive layer, wherein the connecting portion between the first conductor layer and the second conductor layer acts as a bypass through which flow of current having first flowed through superconducting material joining layer is redistributed.

9. A superconducting coil having a central axis, the superconducting coil comprising:

the superconducting wire according to claim 1, the superconducting wire being wound around the central axis.

10. A superconducting magnet comprising:

the superconducting coil according to claim 9;

a cryostat in which the superconducting coil is housed; and a refrigerator configured to cool the superconducting coil.

11. A superconducting device comprising the superconducting magnet according to claim 10.

* * * * *